United States Patent [19]

Bolt

[11] 4,203,171

[45] May 20, 1980

[54] SHOWER CABINETS

[75] Inventor: John A. Bolt, Beaconsfield, England

[73] Assignee: Terrapin International Limited, London, England

[21] Appl. No.: 626,458

[22] Filed: Oct. 28, 1975

[30] Foreign Application Priority Data

Nov. 7, 1974 [GB] United Kingdom ..... 48287/74

[51] Int. Cl.[2] ..... A47K 3/23; A47K 3/24

[52] U.S. Cl. ..... 4/146; 4/153; 211/1.3

[58] Field of Search ..... 4/146–149, 4/154, 145, 153; 211/1.3

[56] References Cited

U.S. PATENT DOCUMENTS

| | | | |
|---|---|---|---|
| 1,493,264 | 5/1924 | Hennessy | 211/1.3 |
| 1,586,065 | 5/1926 | Brown | 211/1.3 |
| 3,869,734 | 3/1975 | Bolt et al. | 4/146 |

FOREIGN PATENT DOCUMENTS

| | | | |
|---|---|---|---|
| 1267705 | 3/1972 | United Kingdom | 4/146 |
| 1337193 | 11/1973 | United Kingdom | 4/146 |

*Primary Examiner*—Stuart S. Levy
*Attorney, Agent, or Firm*—James C. Wray

[57] ABSTRACT

A shower cabinet having a flexible curtain support band secured at each end, respectively, to one of a pair of doors so that when the doors are closed part of the band lies between the doors and the remainder is curved and when the doors open the band is straightened and extends across the front upper part of the cabinet.

1 Claim, 5 Drawing Figures

FIG. 1
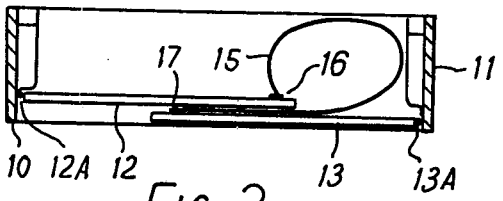
FIG. 2
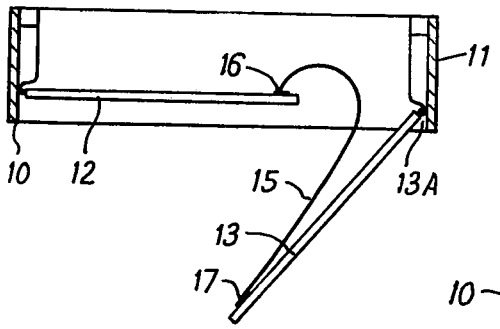
FIG. 5
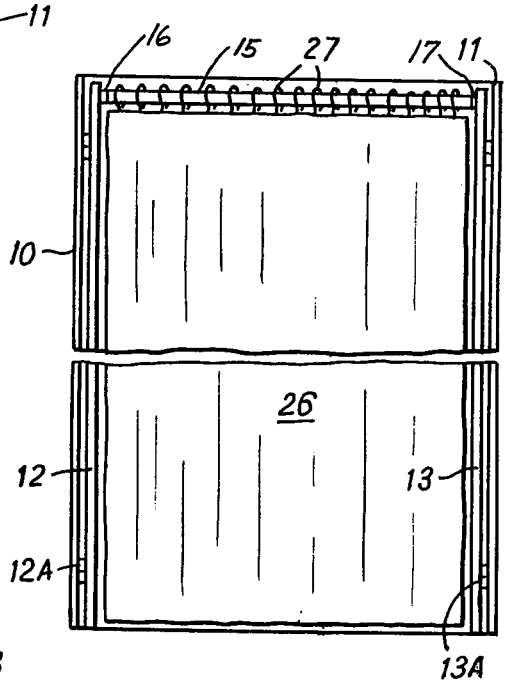
FIG. 3
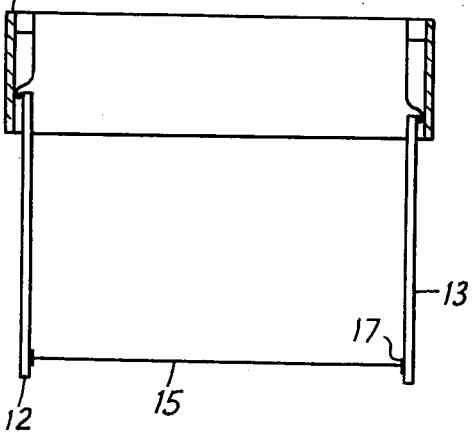
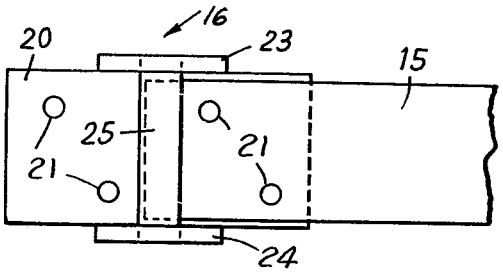
FIG. 4

SHOWER CABINETS

This invention relates to shower cabinets in which a person can take a shower. Examples of such cabinets are described in the specifications of British Pat. Nos. 1267705 and 1337193 these being collapsible to occupy a small front to rear space when not in use. A particular problem for collapsible shower cabinets has been to provide a front curtain which not only hangs to its full length when in use, but also hangs to its full length when the cabinet is in its collapsed condition to avoid having the curtain in a crumpled, wet condition pushed with difficulty into the cabinet. This has been successfully accomplished by means of a curtain carrying bar, supported by folding linkage according to Specification No. 1337193. However, the use of linkage is not ideal for various reasons such as cost, wear at the pivots, and the possibility of corrosion.

According to the present invention, a shower cabinet is provided with a front curtain support consisting of a flexible band which is rigid vertically but flexible in a horizontal plane, the cabinet having a pair of doors to which the ends of the band are secured whereby the band is folded into the cabinet when the doors are closed but is brought out to a position across the front of the cabinet by the opening of the doors. Thus not only is the support simple and cheap to make, but the operation of opening and closing of the cabinet is facilitated since the curtain is automatically moved forward and back by the opening and closing of the doors.

The band may be of any suitable form which gives the required flexibility in the horizontal plane and while a spring linkage band or a metal band might be suitable we have found that a particularly practical form of band consists of a strip of synthetic plastics material about 0.75 to 1.5 inch (e.g. 1.0 inch) deep and one sixteenth to one eighth thick (e.g. 0.1 inch). It may be two to three feet long according to the size of the doors.

One end of the band may be fixed by a hinge to the inside surface of the inner of a pair of overlapping doors near the free edge thereof, while the other end may be fixed by a hinge to the inside surface of the outer door near the free edge thereof.

A constructional form of the invention will now be described by way of example with reference to the accompanying diagrammatic drawings wherein:

FIG. 1 is a plan view of a shower cabinet in closed condition, made in accordance with the invention;

FIGS. 2 and 3 are similar views but showing the doors partly and fully open respectively;

FIG. 4 shows the band attached to a hinge; and

FIG. 5 is a front elevation of the cabinet in open condition.

The cabinet in this example, has a back structure which includes side walls 10, 11 of small depth back to front. Two doors 12, 13 are hinged to the walls 10, 11 respectively at 12A, 13A and are of such size as to overlap each other in closed condition as shown in FIG. 1, and when open provides a shower space in which the user can stand.

A band, 15, of flexible plastics material such as "Makrolone" (sold by Bayer A.G.) rigid in the vertical direction but flexible in a horizontal plane is fixed at its ends to hinge members 16, 17.

The hinge member 16 is fixed to the inside surface of the inner door 12 near the upper part of its free edge and the hinge member 17 is fixed to the outer door 13 near the upper part of its free edge, so that a part of the band lies between the doors in their closed condition, the remainder being within the back structure in curved condition.

When the doors are opened as shown in FIG. 3, the band is straightened and extends across the front upper part of the cabinet. Thus the band at all times remains in the same horizontal plane and the curtain always hangs freely down at its full length so that not only can it always drain, but is easily shut into the back structure.

The cabinet may be provided with means for holding the doors apart so as to hold the band taut when the cabinet is in use.

The cabinet may be provided with all other suitable parts such as a tray and channels to conduct the water to a waste pipe, shower nozzle and a roof member if required.

If desired the walls 10, 11 may be dispensed with and the doors fixed direct to a recessed wall.

FIG. 4 shows the hinge 16 comprising a back plate 20, provided with holes 21 to receive screws and having upstanding lugs 23, 24.

The end of the band 15, is secured by adhesive in a slot which extends diametrically through a pivot 25, which is rotatably mounted in the lugs 23, 24.

The curtain 26 is hung on the band 15 by rings 27. Alternatively the upper edge of the curtain may be fixed to the band 15 by rivets or other means.

I claim:

1. A shower cabinet comprising a pair of doors hinged on vertical hinges, said doors overlapping each other when closed and a front curtain support including a horizontally elongated band which has a thin dimension in a transverse horizontal direction and which has a wide dimension in a vertical direction, which is rigid vertically and curvilinearly flexible in a horizontal plane in all positions of the doors, wherein the band is made of synthetic plastics material 0.75 to 1.5 inch deep and one sixteenth to one eighth inch thick, each end of the band is fixed in a first hinge member which is hinged to a second hinge member that is fixed to the door the ends of the band being secured to said hinge members on the inside surfaces of the doors near their free vertical edges at the upper ends thereof such that when the doors are opened so as to be approximately parallel to each other, the band will extend between them in a horizontal plane and when the doors are closed the band will remain in said horizontal plane and will be hidden from view behind these doors and a curtain mounted on said band, the band and the curtain being automatically curved and straightened with opening and closing of the doors, so that when the doors are closed a first part of the band and curtain lie in a generally flat vertical plane between the doors and a second part of the curtain and band lie in a curved condition behind the doors.

* * * * *